US006949287B2

(12) United States Patent
Huang et al.

(10) Patent No.: US 6,949,287 B2
(45) Date of Patent: Sep. 27, 2005

(54) POLYTETRAFLUOROETHYLENE FIBER AND METHOD FOR MANUFACTURING THE SAME

(75) Inventors: James Huang, Taichung (TW); Chin-Chun Chou, Taichung (TW); Chin-Cha Chou, Taichung (TW); Shia-Chung Chen, Taipei (TW); Wen-I Kuo, Taichung (TW); Lei-Ti Huang, Taichung (TW)

(73) Assignee: Yeu Ming Tai Chemical Industrial Co., Ltd., Taichung (TW)

( * ) Notice: Subject to any disclaimer, the term of this patent is extended or adjusted under 35 U.S.C. 154(b) by 0 days.

(21) Appl. No.: 10/760,863

(22) Filed: Jan. 20, 2004

(65) Prior Publication Data

US 2004/0175567 A1 Sep. 9, 2004

(30) Foreign Application Priority Data

Jan. 20, 2003 (JP) ..... 2003-011626

(51) Int. Cl.[7] ..... D01F 6/00

(52) U.S. Cl. ..... 428/364; 428/397; 428/399; 428/421

(58) Field of Search ..... 428/364, 397, 428/399, 421, 422

(56) References Cited

U.S. PATENT DOCUMENTS 2,772,444 A 12/1956 Burrows et al.
3,953,566 A 4/1976 Gore
4,187,390 A 2/1980 Gore
5,220,932 A * 6/1993 Blass ..... 132/321
5,562,986 A 10/1996 Yamamoto et al.
6,080,472 A * 6/2000 Huang et al. ..... 428/315.5
6,133,165 A 10/2000 Tamaru et al.

FOREIGN PATENT DOCUMENTS

WO WO96/00807 1/1996

* cited by examiner

*Primary Examiner*—N. Edwards
(74) *Attorney, Agent, or Firm*—Hamre Schumann Mueller & Larson P.C.

(57) ABSTRACT

A PTFE fiber with a low density and having a network structure that allows effective performances to be given to its finished articles and a method for manufacturing the PTFE fiber are provided. The PTFE fiber is a filament obtained by giving a heat treatment to a biaxially stretched polytetrafluoroethylene (PTFE) film, followed by slitting partially in a lengthwise direction of the film. The filament includes a network structured fiber in which single fibers are opened partially in the width direction, and the filament is an aggregate of the single fibers. This fiber is manufactured as the filament by feeding a biaxially stretched PTFE film to a revolving pin roll with needles implanted thereon, the needles being arranged so that a plurality of rows run obliquely along a circumferential direction at substantially regular intervals, and slitting the film partially in a lengthwise direction. This PTFE filament may be cut into short fibers with a cutter. The short fibers include a branch structure.

7 Claims, 3 Drawing Sheets

POLYTETRAFLUOROETHYLENE FIBER AND METHOD FOR MANUFACTURING THE SAME

BACKGROUND OF THE INVENTION

1. Field of the Invention

The present invention relates to novel polytetrafluoroethylene (PTFE) fibers and a method for manufacturing the same, and more particularly relates to PTFE fibers with a reduced density.

2. Related Background Art

Since PTFE resins have a considerably high melting viscosity and are not dissolved by most solvents, fibers cannot be produced by a generally adopted method such as extrusion spinning of molten resins and resin solutions. Therefore, various specific manufacturing methods have been adopted conventionally. U.S. Pat. No. 2,772,444 proposes a method for manufacturing a PTFE fiber by emulsion spinning of a mixed solution of an aqueous dispersion solution of PTFE fine particles and viscose, followed by sintering of the PTFE at high temperatures, while removing the viscose by thermal decomposition. However, the manufacturing cost of the PTFE by this method is high, whereas the strength of the fiber obtained is low, and therefore the strength of a product obtained by processing this fiber as a raw material also is low.

U.S. Pat. No. 3,953,566 and U.S. Pat. No. 4,187,390, for example, propose a method for manufacturing a high-strength PTFE fiber by slitting a PTFE film or sheet into a minute width, followed by stretching of the obtained tape. However, this method has a difficulty in maintaining a width of the tape obtained by slitting uniformly along the lengthwise direction. Also, there exists a problem that an end portion of the tape tends to be a fibril. For these reasons, there exists another problem that the fiber may break partially during the step of stretching the tape with a high degree.

U.S. Pat. No. 5,562,986 proposes a method for manufacturing cotton-like materials made of PTFE fibers having a branch structure by opening a uniaxially stretched article, specifically a uniaxially stretched film of a molded PTFE article by a mechanical force using a pin roll with a needle density of 20 to 100 needles/cm$^2$. According to this method, however, a length of the obtained PTFE fibers mostly is not more than 150 mm, and it is difficult to obtain a PTFE filament.

WO96-00807 proposes a method for manufacturing cotton-like materials made of PTFE fibers having a branch structure by opening a uniaxially stretched film of a molded PTFE article by a mechanical force. According to this method, however, a density of the obtained PTFE fibers becomes a high specific gravity exceeding 2.15 g/cm$^3$, thus making it difficult to obtain a light-weight final product.

SUMMARY OF THE INVENTION

Therefore, with the foregoing in mind, it is an object of the present invention to provide a PTFE filament having a low density and high strength and having a network structure that allows effective performances to be given to its finished articles and to provide a method for manufacturing the PTFE fiber with high efficiency and at a low manufacturing cost.

Additionally, it is another object of the present invention to provide short PTFE fibers with a branch structure having any length suitable for a purpose of processing by adjusting a density of the PTFE fiber and cutting the network-structured PTFE fiber.

In order to achieve the above-stated objects, polytetrafluoroethylene (PTFE) fiber of the present invention includes a filament obtained by giving a heat treatment to a biaxially stretched PTFE film, followed by slitting partially in a lengthwise direction of the film. The filament includes a network structure in which, when the filament is extended in a width direction thereof, single fibers are opened partially, and the filament is an aggregate of the single fibers.

Next, a short PTFE fiber of the present invention is a short fiber including a branch structure that is obtained by cutting the above-stated filament.

Next, a method for manufacturing a PTFE fiber of the present invention includes the steps of: feeding a biaxially stretched PTFE film subjected to a heat treatment to a revolving pin roll; and slitting the film partially in a lengthwise direction of the film so as to manufacture a filament. Needles implanted on the pin roll are arranged so that a plurality of rows run obliquely along a circumferential direction at substantially regular intervals. The pin roll rotates in a direction of the feeding of the stretched film and a peripheral speed of the pin roll is made larger than a feeding speed of the stretched film, whereby the stretched film is opened in a network form so as to obtain the filament.

Next, a method for manufacturing a short PTFE fiber of the present invention includes the steps of: cutting the PTFE filament obtained by the above-stated manufacturing method into a short fiber with a cutter, so as to form the short PTFE fiber including a branch structure.

The PTFE filaments of the present invention can be twined so as to be used for a high-strength fabric, surgical sutures and the like. Especially, a fiber obtained from a biaxially stretched film can have a reduced density, and therefore is effective for reducing a weight of its finished articles and the manufacturing cost.

A network structure that is one of the features of the PTFE filament of the present invention is effective for manufacturing finished articles impregnated with resins and oils. In sealing materials obtained from twines and by further braiding the twines, when the sealing materials are impregnated with a resin dispersion solution, an oil and the like, the penetration into the inside of the sealing materials can be promoted, thus enhancing the properties of holding the impregnation material.

Furthermore, according to the manufacturing method of the present invention, a low-density and high-strength PTFE fiber having a specific network structure can be manufactured stably by a simple process and at a relatively low cost.

DETAILED DESCRIPTION OF THE INVENTION

Figure 1:
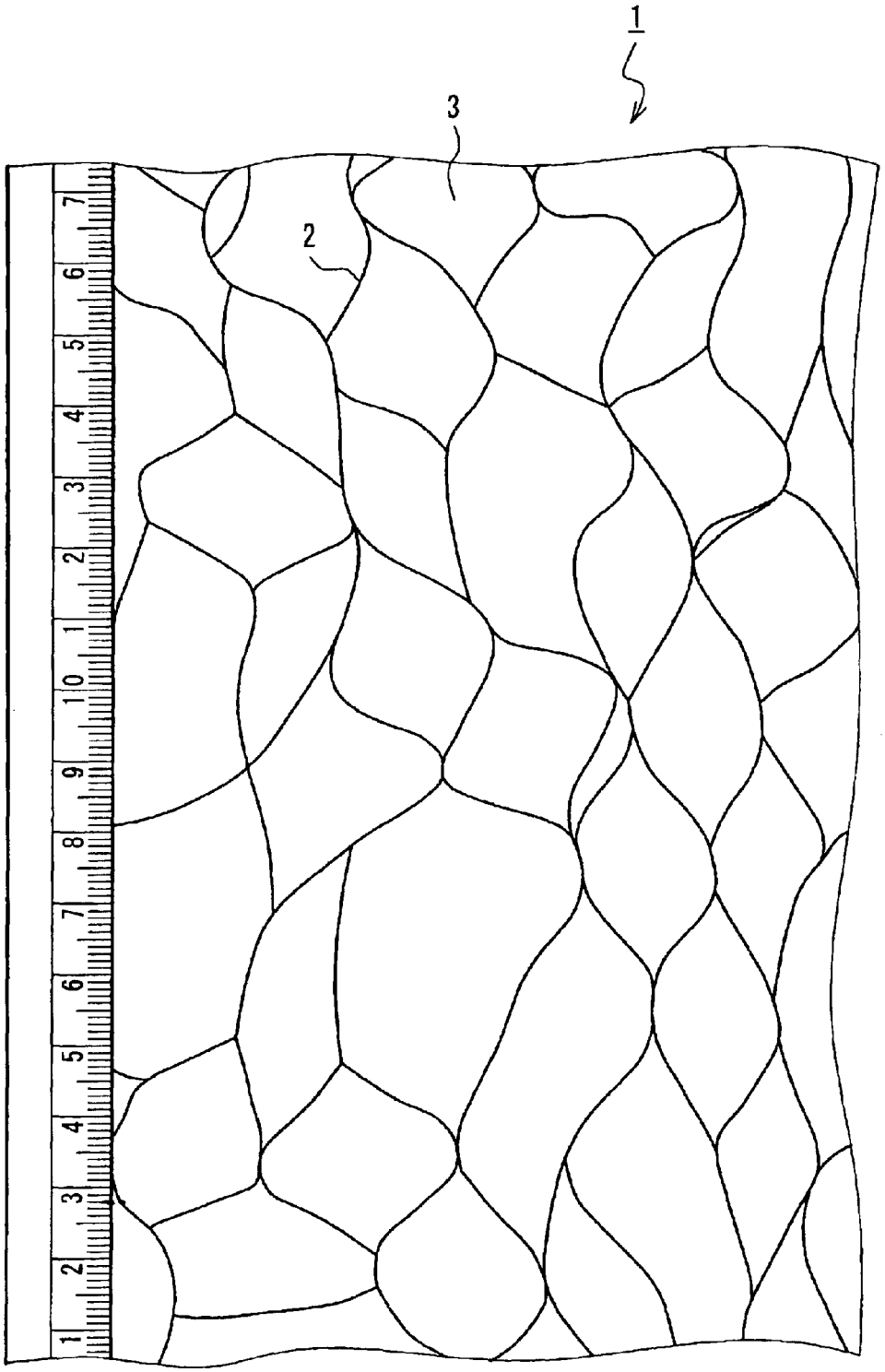
FIG. 1 shows a network structure of a PTFE filament in one example of the present invention.

A PTFE fiber of the present invention is a low-density filament obtained as follows: that is, a PTFE film is biaxially stretched, followed by a heat treatment at temperatures of at least the melting point of PTFE (327° C.) or more. The resulting PTFE film is slit partially in its lengthwise direction, whereby the PTFE fiber of the present invention is obtained. Furthermore, this filament includes a network structure in which, when the filament is extended in the width direction, single fibers are opened partially. Thus, short fibers obtained by cutting this filament include a branch structure. This fiber is a slit fiber having a fibril structure, and when the fiber is extended in the width direction, the resulting has a network structure in which single fibers are opened partially. FIG. 1 shows one example of the same, indicating a network structured filament 1 where one single fiber 2 measures, as one example, 13 μm×7 μm to 143 μm×32 μm (long axis×short axis). Portions 3 constituting the network have various sizes and have no regular shape. A length of the short fiber ranges from 1 cm to 30 cm, as one example, and preferably ranges from 2 cm to 10 cm.

The fiber of the present invention is an aggregate of these single fibers. A fineness of this fiber aggregate preferably is 3 to 600 dtex. In addition, the slit fiber of the present invention preferably has a flat shape and has a thickness of 5 μm to 450 μm. An apparent density of the fiber is not more than 2 g/cc, and preferably is not more than 1.8 g/cc. Since a true specific gravity of PTFE is 2.15 to 2.20 g/cc, the specific gravity is low. This results from the biaxially stretching. A low-density fiber has better crimp properties than a high-density fiber. For example, a fiber having an apparent density not more than 2 g/cc can give 10 to 12 crimps/25 mm, whereas a fiber exceeding 2 g/cc gives less than 5 crimps/25 mm only. This is because the fiber becomes stiff.

According to the present invention, a PTFE film obtained from PTFE fine powders as a raw material by an emulsion polymerization method is biaxially stretched, followed by a heat-treatment at temperatures not less than the melting point (327° C.), and the resulting film is opened mechanically using a pin-roll with a low needle density. In this way, the present invention solves technical problems of the PTFE fiber manufacturing. Thereby, a filament can be obtained by opening using a single pin-roll and not using an expensive pair pin-roll. Furthermore, a filament can be manufactured by opening of the biaxially-stretched PTFE film, which has been considered an impossibility conventionally.

The PTFE film can be manufactured by conventionally known methods. That is, a mixture of PTFE fine powders and a petroleum oil as an extrusion aid is subjected to a paste extrusion method, so that a continuously extruded article in a rod, bar or sheet shape is molded. Next, this extruded article is rolled to be a film form using a reduction roll, and then a solvent is extracted from the rolled film or heat is applied thereto so as to remove the extrusion aid, whereby a PTFE original film is obtained.

A mixing ratio by weight of the PTFE fine powders and the extrusion aid normally ranges from 80:20 to 77:23, and a reduction rate (RR) of the paste extrusion is not more than 300:1. A heating method often is adopted for removing the extrusion aid, and its temperature is not more than 300° C. and preferably is from 250° C. to 280° C.

The PTFE fiber of the present invention is manufactured by stretching this original film biaxially, followed by the heat treatment at temperatures not less than the melting point and the opening using a pin-roll with a low needle density. The biaxially stretching is conducted by 4 times or more in the lengthwise direction (MD) and preferably by 6 times or more. The stretching in the width direction (TD) of the film perpendicular to the MD direction is from 1.5 times to 5 times, inclusive, and preferably is from 2 times to 3 times, inclusive. The biaxially stretching may be conducted so that stretching is conducted concurrently in the MD direction and the TD direction or may be conducted as two-stage stretching in which the stretching in the TD direction follows the stretching in the MD direction. According to the opening of the biaxially-stretched film, a relatively low-density PTFE fiber can be obtained, which leads to an advantage in reducing the cost per volume of the fiber and its finished articles.

Although the PTFE film can be heat-treated within a temperature range from 327° C. to 400° C., inclusive, the heat treatment within a temperature range from 350° C. to 400° C., inclusive, is preferable. The heat treatment can reduce a tendency of the generated PTFE fiber to form lumps, so that the handleability of the fiber can be improved.

A thickness of the PTFE film fed for the opening ranges from 5 μm to 450 μm, and preferably ranges from 150 μm to 400 μm.

Regarding the formation of the heat-treated film, the procedure of stretching the original film, followed by the heat treatment is described in detail as above. However, another procedure may be adopted in which after the heat treatment of the original film, the resulting film is stretched and fed for the opening.

Figure 4:
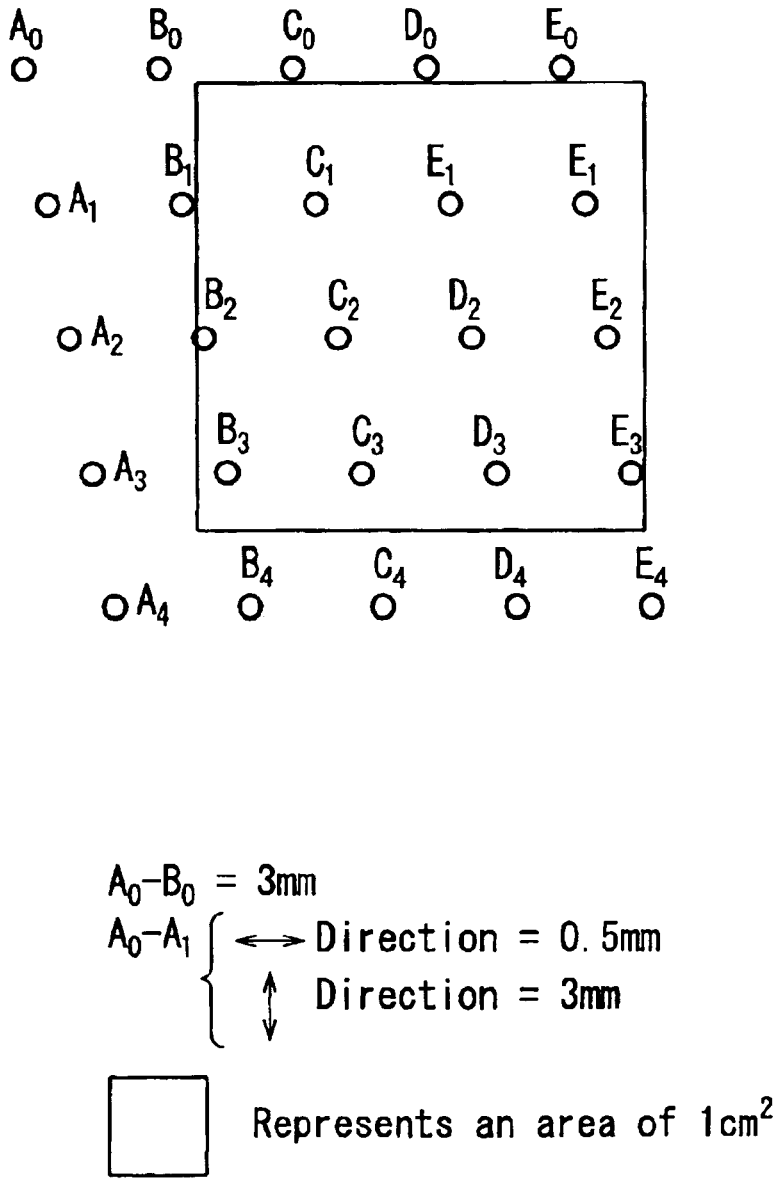
FIG. 4 shows an arrangement of needles on a pin-roll used for manufacturing a PTFE filament of one example of the present invention.

The manufacturing of a PTFE filament by opening will be described below. In the present invention, a filament means the fiber having a length substantially equal to that of the PTFE film that is fed for the opening. The supplied film may have any length, and as one example, a length of about 1,000 m to 10,000 m is practical. A diameter of needles on the pin-roll used ranges from 0.2 mm to 0.7 mm, and a length of the same ranges from 3 to 10 mm. A density of needles is from 3 to 15 needles/$cm^2$, preferably is from 3 to 12 needles/$cm^2$, and more preferably is from 4 to 8 needles/$cm^2$. If the density of needles exceeds 15 needles/$cm^2$, a PTFE filament cannot be obtained, resulting in the generation of short fibers not more than about 200 mm. FIG. 4 shows a preferable example of the needle arrangement on a surface of the pin-roll. The arrangement is not limited to this. The pin-roll rotates at a peripheral speed of 50 to 400 m/min, and preferably at 60 to 200 m/min. A feeding speed of the stretched PTFE is from 10 to 50 m/min, and preferably is from 15 to 35 m/min.

Figure 2:
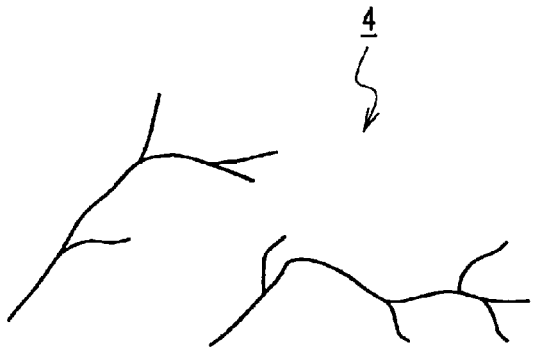
FIG. 2 shows a network structure of a short PTFE fiber in one example of the present invention.

Short PTFE fibers can be manufactured by cutting the PTFE fiber having a network structure obtained from the above opening process into any length depending on the purpose of the application and the intended use. When short fibers are to be formed, the fibers are cut into a length of about 30 mm to 100 mm, and preferably of about 50 mm to 80 mm. At this time, the network structure of the PTFE filament is broken, so that the short PTFE fibers assume branch-structured short fibers 4 as shown in FIG. 2.

The PTFE filament and the short PTFE fiber of the present invention can be processed into application products which are required to have heat resistance, chemical stability and the like.

WORKING EXAMPLES

The following describes the present invention more specifically, with reference to working examples.

(Manufacturing of PTFE Original Film)

To 80 mass parts of PTFE fine powders obtained by an emulsion polymerization method, 20 mass parts of naphtha was mixed. This mixture was subjected to paste extrusion through a die with an angle of 60° under the condition of RR of 80:1 so as to obtain a circular bar with a diameter of 17 mm. This extruded article was rolled between a pair of rolls with a diameter of 500 mm, followed by the removal of the naphtha at a temperature of 260° C. The thus obtained PTFE film measured a length of about 250 m, a film thickness of 0.2 mm and a width of about 260 mm.

Working Example 1

The PTFE original film obtained by the above-stated process was biaxially stretched, in which the film was stretched by 6 times in the lengthwise direction and concurrently stretched by 1.5 times in the width direction. Thereafter, this film was heat-treated at 370° C. for 5 seconds. The thus obtained stretched and baked PTFE film measured a length of about 2,100 m, a film thickness of 0.06 mm and a width of about 300 mm. This PTFE film was fed to a revolving roll with needles, so that a PTFE filament having a network structure was obtained.

Figure 3:
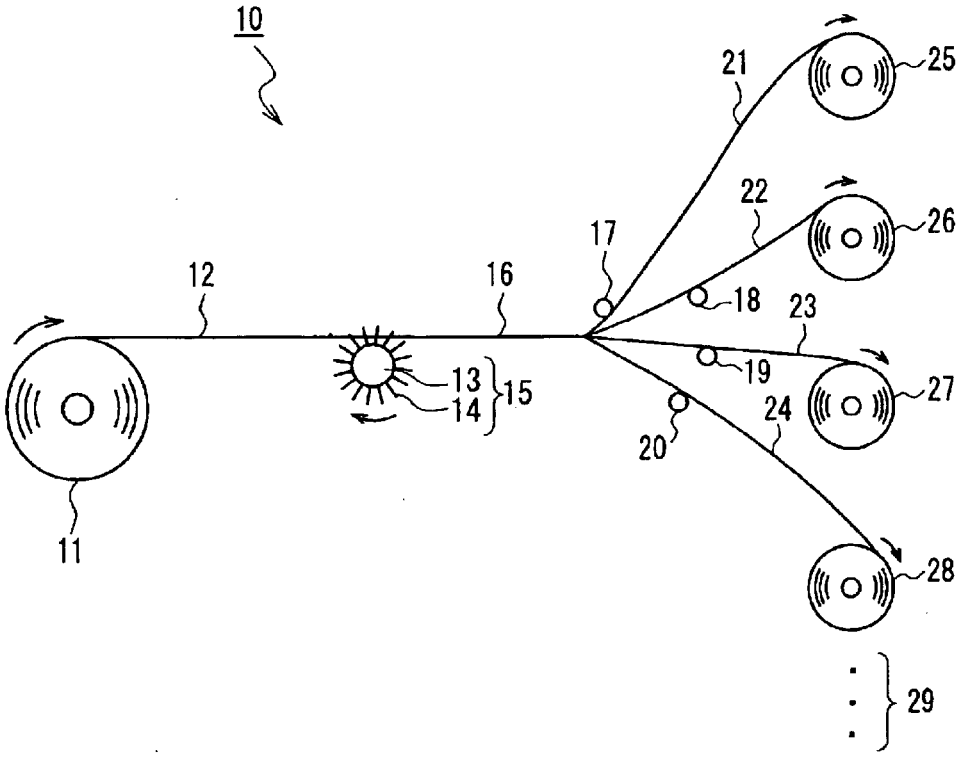
FIG. 3 shows an apparatus for manufacturing a PTFE filament of one example of the present invention.

FIG. 3 shows an apparatus for manufacturing the PTFE filament of this working example. In this manufacturing apparatus 10, a PTFE stretched film 12 was sent out of a film feeding roll 11, and the PTFE stretched film 12 was opened by a revolving roll with needles (pin-roll) 15 configured by implanting needles (pins) 14 on a surface of a revolving roll 13, so as to form a network structured fiber 16. Next, the fiber 16 was slit into each filament (long fiber) 21 to 24, which then passed through guides 17 to 20, respectively, to be wound on the respective winders 25 to 29. The number of winders may be set at any numbers depending on a design for making a filament with a required fineness from the PTFE stretched film 12.

The revolving roll with needles (pin-roll) had a needle density of 6 needles/cm$^2$, a needle length of 5 mm and a roll diameter of 50 mm. In FIG. 4, a distance between needles $A_0$ and $B_0$ (axis direction) was 3 mm, a distance between $A_0$ and $A_1$ in the horizontal direction (axis direction) was 0.5 mm and a distance between $A_0$ and $A_1$ in the vertical direction (circumferential direction) was 3 mm. $A_0$ to $A_4$ run obliquely at regular intervals, and $A_4$ and a row beginning with $B_0$ also run obliquely at regular intervals.

As the conditions of the opening, a peripheral speed of the roll was 120 m/min and a feeding speed of the film was 30 m/min.

A fineness of the filament obtained was 32.7 dtex. When this filament was taken out and was extended in the width direction, the network structure as shown in FIG. 1 was confirmed, where five portions constituting the network were found in a length of 70 mm, and a size of single fibers constituting the portions measured 12 $\mu$m×7 $\mu$m to 124 $\mu$m×28 $\mu$m (long axis×short axis). The other physical properties are shown in Table 1.

Working Example 2

The original PTFE film was biaxially stretched by concurrently stretching by 8 times in its lengthwise direction and by 2 times in its width direction. The other conditions were the same as in Working Example 1 so as to carry out the heat treatment and the opening, whereby a PTFE filament having a network structure was obtained.

Working Example 3

The same conditions as in Working Example 1 were used except that the stretching ratio of the original film was changed to 25 times in the lengthwise direction and 1.5 times in the width direction and the heat treatment was conducted at 380° C. for 3 seconds.

Working Example 4

The same conditions as in Working Example 1 were used except that the stretching ratio of the original film was changed to 35 times in the lengthwise direction and 1.5 times in the width direction and the heat treatment was conducted at 380° C. for 3 seconds.

Comparative Example 1

The manufacturing of PTFE fiber was attempted by changing the roll for opening to a pin-roll with a needle density of 25 needles/cm$^2$, and under the other conditions that were the same as in Working Example 1. However, the biaxially stretched PTFE fed thereto resulted in breaking irregularly, and fiber-form PTFE could not be obtained.

Comparative Example 2

A PTFE filament was obtained under the same conditions as in Working Example 1 except that the original film was uniaxially stretched by 25 times in its lengthwise direction. An apparent density of the filament was 2.19 g/cc.

Table 1 shows the results of Working Examples 1 to 4 and Comparative Examples 1 and 2. In Table 1, a density, a fineness, a strength and an elongation percentage of PTFE fibers were estimated in accordance with JIS1015.

TABLE 1

| | Density (g/cm$^3$) | Fineness (dtex) | Strength (CN/dtex) | Elongation Percentage (%) | Appearance of Fibers (the number of branches per 70 mm)* |
|---|---|---|---|---|---|
| Ex. 1 | 1.65 | 32.7 | 0.85 | 6.1 | Network structure (3 portions) |
| Ex. 2 | 1.79 | 32.3 | 0.78 | 5.7 | Network structure (4 portions) |
| Ex. 3 | 1.65 | 28.5 | 0.70 | 5.6 | Network structure (3 portions) |
| Ex. 4 | 1.62 | 28.0 | 0.73 | 4.3 | Network structure (2 portions) |
| Comparative Ex. 1 | Failure in opening in a fiber form (breaking of film) | | | | |
| Comparative Ex. 2 | 2.19 | 39.3 | 0.70 | 14.1 | Network structure (5 portions) |

(Remark)
*The number of branches was measured in a state where the generated fiber was cut into 70 mm.

As is evident from Table 1, the opening using a pin-roll with a low needle density allows the opening of a biaxially stretched PTFE film, which has been considered an impossibility conventionally, and as shown in Working Examples 1 to 4, filaments having a network structure can be manufactured. The biaxially stretched PTFE film has porosity and the porosity structure can be maintained even in the heat treatment after the stretching. Therefore, the generated fibers easily have a reduced density, which leads to an advantage in enabling light-weight finished articles.

Furthermore, short fibers that were obtained by cutting the filaments of Working Examples 1 to 4 into a length of 70 mm had a network structure that has been cut and was low-density short fibers showing a branch structure as shown in FIG. 2.

On the other hand, the opening using a roll with a high needle density (Comparative Example 1) resulted in the breaking of the film and a fiber-form product could not be obtained.

Short fibers obtained by cutting the PTFE filament of the present invention have a branch structure, and are considerably effective for high-temperature resistant felt, printed boards and webs and prepregs for bag filters, in addition to the above-stated applications.

The invention may be embodied in other forms without departing from the spirit or essential characteristics thereof. The embodiments disclosed in this application are to be considered in all respects as illustrative and not limiting. The scope of the invention is indicated by the appended claims rather than by the foregoing description, and all changes which come within the meaning and range of equivalency of the claims are intended to be embraced therein.

What is claimed is:

1. A biaxially oriented polytetrafluoroethylene (PTFE) fiber, having a density of not more than 2 g/cm$^3$, comprising a filament obtained by giving a heat treatment to a biaxially oriented PTFE film, followed by slitting partially in a lengthwise direction of the film, wherein the filament comprises a network structure in which, when the filament is extended in a width direction thereof, single fibrils are opened partially, wherein the filament is composed of the single fibrils.

2. The PTFE fiber according to claim 1, wherein a temperature of the heat treatment given to the biaxially oriented PTFE film ranges from 327° C. to 400° C., inclusive.

3. The PTFE fiber according to claim 1, wherein the biaxially oriented PTFE film is stretched by 4 times or more in the lengthwise direction of the film and by 1.5 times to 5 times, inclusive, in a width direction of the film.

4. The PTFE fiber according to claim 3, wherein the density of the PTFE fiber is not more than 1.8 g/cm$^3$.

5. The PTFE fiber according to claim 1, wherein the PTFE filament has a flat shape and a thickness ranging from 5 $\mu$m to 450 $\mu$m, inclusive.

6. The PTFE fiber according to claim 1, wherein a fineness of the PTFE filament ranges from 3 dtex to 600 dtex, inclusive.

7. A PTFE fiber comprising a short fiber including a branch structure that is obtained by cutting the filament according to claim 1.

* * * * *